US005203457A

United States Patent [19]

Garcia

[11] Patent Number: 5,203,457

[45] Date of Patent: Apr. 20, 1993

[54] DEVICE FOR DISPENSING PLANAR ARTICLES AND WRAPPER FOR EACH ARTICLE

[76] Inventor: Nancy C. Garcia, Acorn Export P.O. Box 6221, Laguna Niguel, Calif. 92677-6221

[21] Appl. No.: 867,337

[22] Filed: Apr. 13, 1992

[51] Int. Cl.[5] ..... B65D 85/62

[52] U.S. Cl. ..... 206/499; 206/77.1; 206/449; 221/305; 221/309; 229/69; 229/87.04

[58] Field of Search ..... 206/449, 499, 526, 77.1, 206/804; 229/87.01, 87.04, 87.05, 69; 221/25, 70, 305, 309

[56] References Cited

U.S. PATENT DOCUMENTS

| | | | |
|---|---|---|---|
| 422,865 | 3/1890 | Wheeler | 229/69 |
| 2,177,999 | 10/1939 | Schwantes | 229/87.01 X |
| 2,380,367 | 7/1945 | Ranney | 206/449 X |
| 2,409,362 | 10/1946 | Kleinmann . | |
| 2,893,550 | 7/1959 | Sandmeyer | 206/499 |
| 4,170,325 | 10/1979 | Pawlowski et al. | 206/526 |
| 4,913,311 | 4/1990 | Garcia . | |

FOREIGN PATENT DOCUMENTS

| | | | |
|---|---|---|---|
| 67871 | 1/1940 | Czechoslovakia | 206/449 |
| 464349 | 1/1913 | France | 206/77.1 |

*Primary Examiner*—Bryon P. Gehman
*Attorney, Agent, or Firm*—Richard C. Litman

[57] ABSTRACT

An improved wrapper for planar articles that are to be stacked in a dispenser and manually engaged by a tab. Several embodiments of wrappers are discussed, each having an integral tab cut from a panel of the wrapper and extended from the wrapper. In one form, alternating wrapper tabs are of alternating positions so as to reduce the possibility of one wrapper inadvertently pulling and adjacent, superimposed wrapper with it when the tab of the lower wrapper is pulled, to dispense an article from the dispenser.

3 Claims, 5 Drawing Sheets

DEVICE FOR DISPENSING PLANAR ARTICLES AND WRAPPER FOR EACH ARTICLE

BACKGROUND OF THE INVENTION

1. Field of the Invention

The present invention relates to dispensers, especially the wrapping of planar objects for dispensing, the objects or items being stacked in a dispenser and engaged in a sequential manner.

2. Description of the Prior Art

The present invention relates to different methods of wrapping sequentially engagable soap leaves in a dispenser for use in public lavatories. The most common type of soap dispensers currently in use in public lavatories and conveyances are usually liquid types with various pumping mechanisms or small bars of solid soap commonly used by all patrons. Objections to these arrangements include the mess that the liquid pumps often deposit on the sinks and the unhygienic aspects of a commonly shared bar of soap.

My own prior U.S. Pat. No. 4,913,311 issued Apr. 3, 1990 discloses a soap leaf dispensing system wherein the packets are stacked in a housing that is open at the front bottom edge, and through which protrudes a graspable pull tab that, when pulled by the user, dispenses one of the soap leaf packets. By virtue of a flap on the packet, the next pull tab in the stack is deployed, preparing it to be used.

U.S. Pat. No. 2,409,362 issued Oct. 15, 1946 to Max Kleinmann discloses a packaging system wherein automatic feeding of wrapped stackable items in a container allows the dispensing of one or a group of the items while unwrapping the item so it is ready for use and is easily detachable from other stacked items in the container.

Neither one of the above inventions and patents, taken either singly or in combination, is seen to describe the instant invention as claimed.

SUMMARY OF THE INVENTION

Accordingly, it is a principal object of the invention to provide an improved wrapper for a soap leaf dispensing system; by punching out a section of the wrapper on three sides, a pull tab is created to grasp the wrapper and enclosed article, thereby minimizing the waste of paper in the manufacturing process.

It is another object of the invention to provide an improved wrapping technique where the graspable flaps are staggered to prevent the engagement of more than one of the stacked packages.

It is a further object of the invention to provide an improved folding technique where an extra flap is used to prevent excess humidity from reaching the soap leaf through the window created in the punching out of the pull tab.

It is a still further object of the invention to provide wrappers that are easily stackable so that they can be inserted in the dispenser and will deploy in a sequential manner when the bottom tab is pulled.

It is an object of the invention to provide improved elements and arrangements thereof in an apparatus for the purposes described which in inexpensive, dependable and fully effective in accomplishing its intended purposes.

These and other objects of the present invention will become readily apparent upon further review of the following specification and drawings.

FIGS, 2A, 2B, and 2C are schematic elevational views sequentially showing the folds used for the enclosure of the packaged article in the second embodiment.

Figure 3:
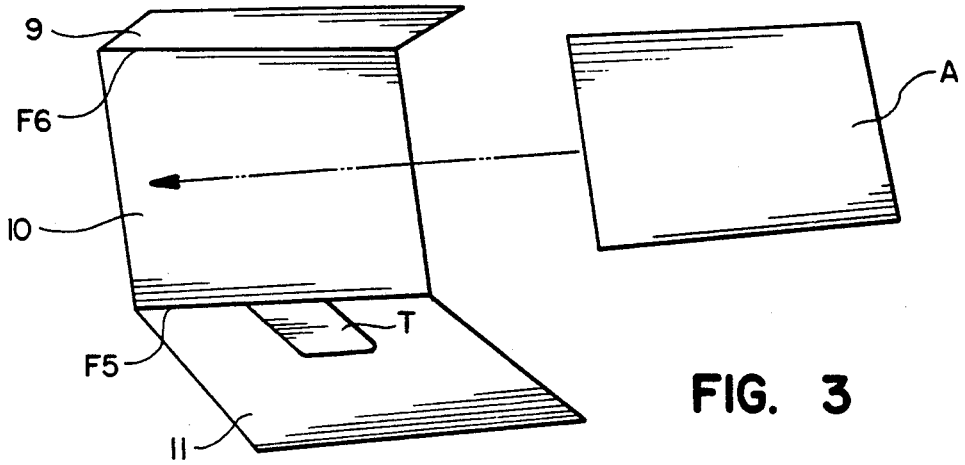

FIG. 3 is a perspective view of the third embodiment of the improved wrapper showing an alternative arrangement of the enclosing folds.

Figure 3A:
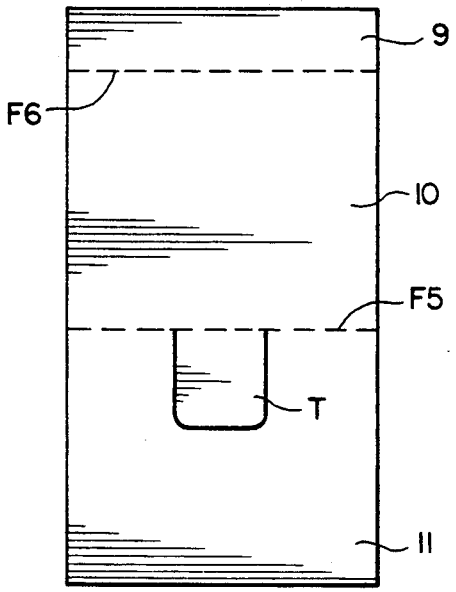
Figure 3B:
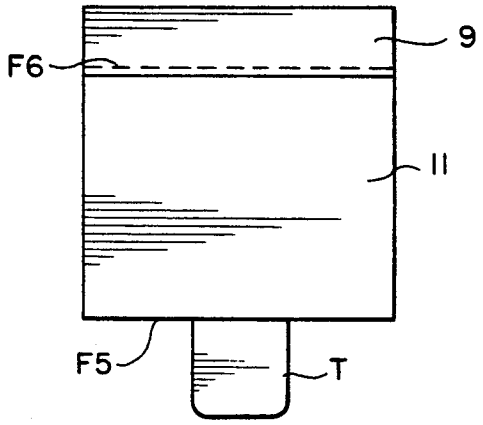
Figure 3C:
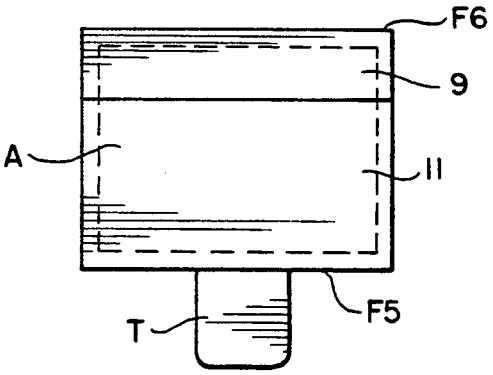

FIGS. 3A, 3B, and 3C are schematic elevational views sequentially showing the folds used for the enclosure of the packaged article in the third embodiment of the invention.

Figure 4:
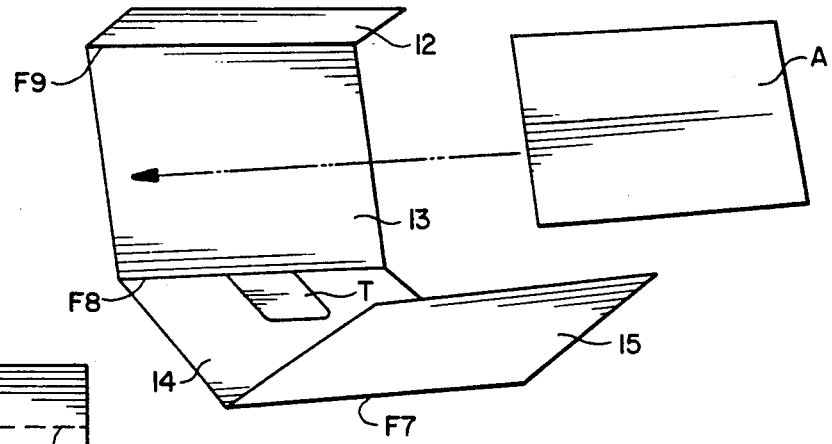
Figure 4A:
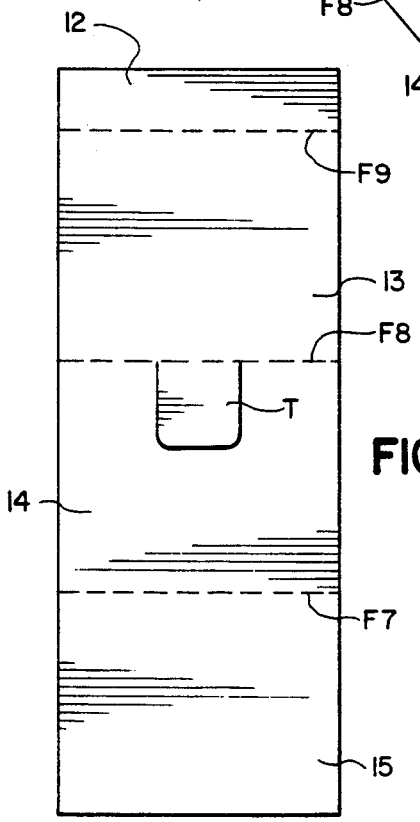

FIG. 4 is a perspective view of the fourth embodiment of the improved wrapper showing the addition of an extra fold to protect the enclosed article from humidity, contamination, or the like.

FIGS. 4A, 4B, 4C and 4D are schematic elevational views sequentially showing the folds used for the enclosure of the packaged article in the fourth embodiment.

Figure 5:
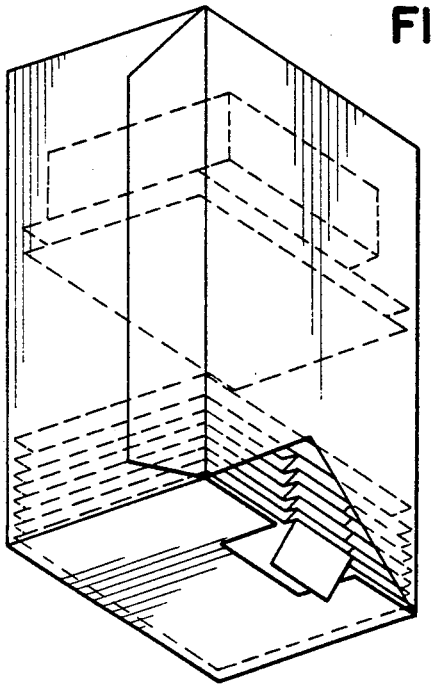
FIG. 5 (PRIOR ART)

FIG. 5 is an environmental perspective view showing a container holding the stacked packages and displaying the tab means for grasping and removing the items; the container, per se, is a prior art container.

Figure 6:
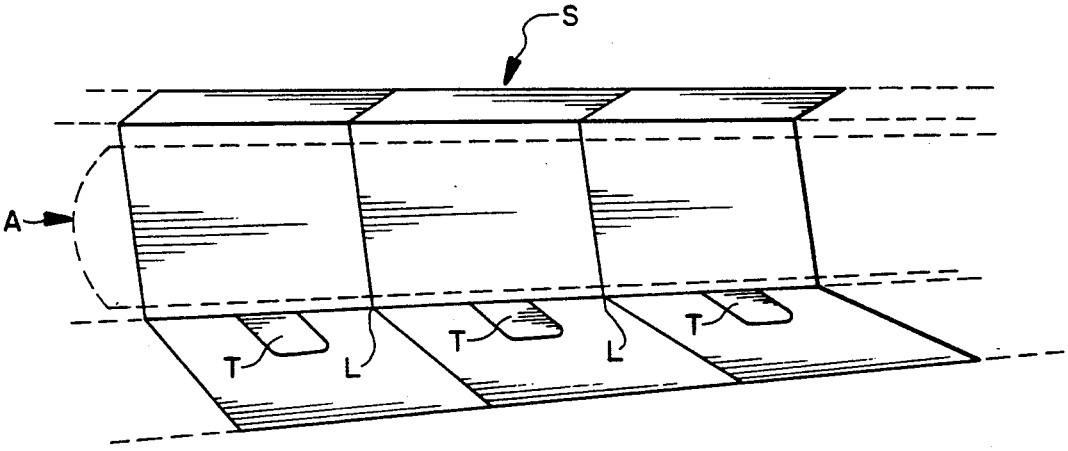

FIG. 6 is an environmental perspective view of the partially folded wrappers in a continuous strip as they would come off a web feed roll for the cutting and folding process. This view shows the cut out for the pull tab already punched, but the wrappers have not yet been separated from one another for stacking.

Similar reference characters denote corresponding features consistently throughout the attached drawings.

DETAILED DESCRIPTION OF THE PREFERRED EMBODIMENTS

The four embodiments of the present invention are shown in FIGS. 1, 2, 3, and 4. The planar article to be dispensed is designated A in all of these figures and the cut out graspable tab T is likewise marked.

Figure 1:
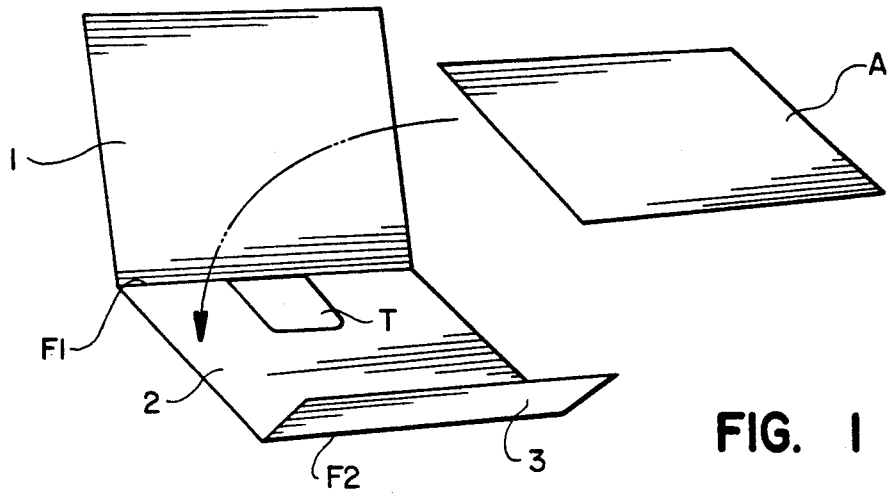
FIG. 1 is a perspective view of the first embodiment of the improved wrapper.
Figure 1A:
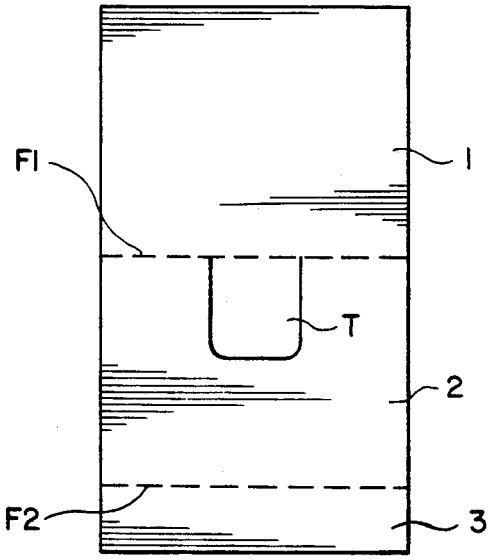
FIGS. 1A, 1B, and 1C are schematic elevational views sequentially showing the folds used for the enclosure of the packaged article in the first embodiment.
Figure 1B:
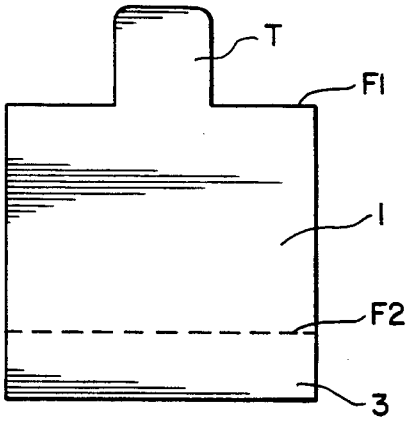
Figure 1C:
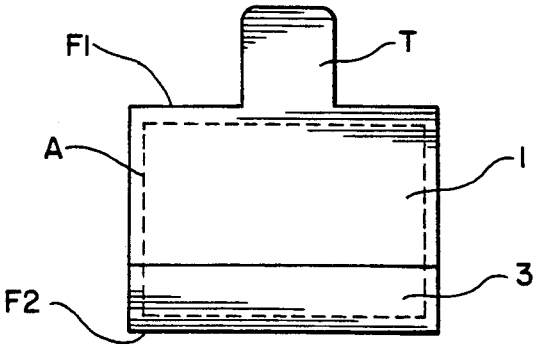

Referring to FIG. 1, in this embodiment, the wrapper is divided into three sections 1, 2, and 3 along the two fold lines F1 and F2. The tab T is shown lying evenly with section 2, from which it is cut out on the three sides associated with section 2 but remains integrally attached to section 1 along fold line F1. FIG. 1B shows a view of the wrapper after section 1 has been folded over section 2 along fold line F1 and tab T has been extended out for handling. FIG. 1C shows a view of the wrapper after section 3 has been folded over section 1 along fold line F2. The broken lines in FIG. 1C indicate the position of the planar article A enclosed in the first embodiment.

Figure 2:
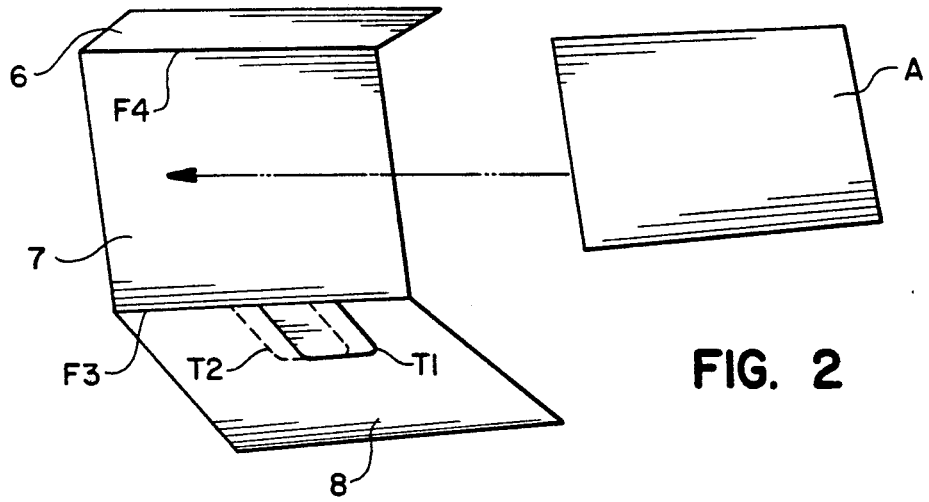
FIG. 2 is a perspective view of the second embodiment of the improved wrapper showing the alternative positions of the cut out for the pull tab.
Figure 2A:
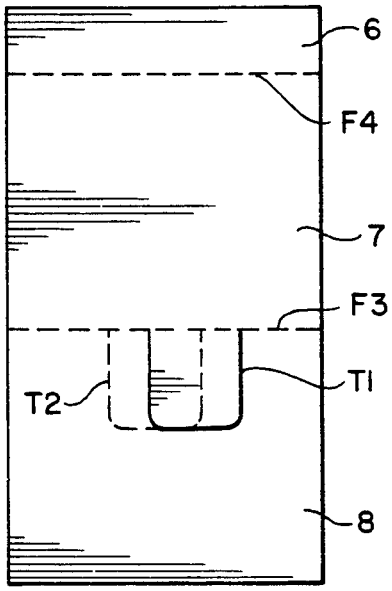
Figure 2B:
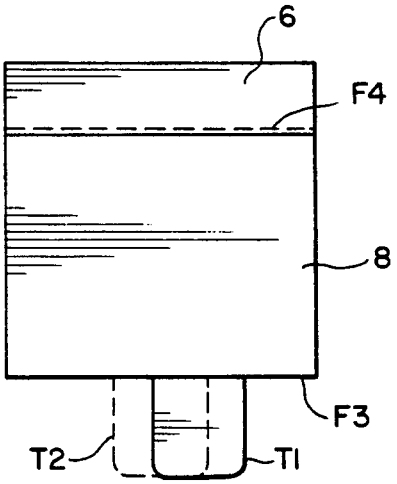
Figure 2C:
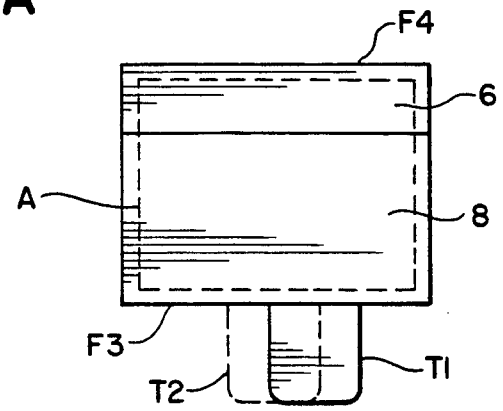

Referring to FIG. 2, in this embodiment, the wrapper is divided into three sections 6, 7, and 8 along the two fold lines F3 and F4. Another feature of this embodiment is the two optional positions of the tab cutouts marked as T1 and T2 which, when used alternately when the wrappers are stacked in a dispenser, obviates the problem of a tab accidentally catching in the next wrapper's window. Analgous to FIG. 1, the tab T1 or T2 (both its alternate positions) is shown lying evenly with the section from which it is cut, in this case section 8, and it remains integrally joined to section 7 along fold line F3. FIG. 2B shows a view of the wrapper after section 8 has been folded over section 7 along fold line F3 and tab T has been extended. FIG. 2C shows a view of the wrapper after section 6 has been folded over section 8 along fold line F4. The broken lines in FIG. 2C indicate the position of the planar article A enclosed in the second embodiment.

Referring to FIG. 3, in this embodiment, the wrapper is divided into three sections 9, 10, and 11 along fold lines F5 and F6. The tab T is cut from section 11 and is integrally joined to section 10 along fold line F5. FIG. 3B shows a view of the wrapper after section 11 has been folded over section 10 along fold line F5 and the tab T has been extended. FIG. 3C shows a view of the wrapper after section 9 has been folded over section 11 along fold line F6. The broken lines show the position of the planar article A enclosed in the third embodiment.

Figure 4B:
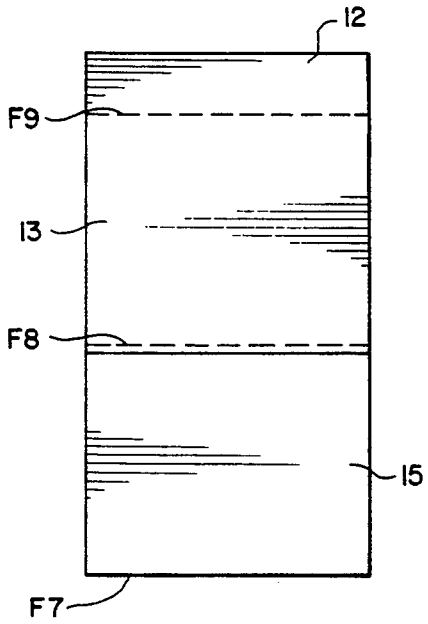
Figure 4C:
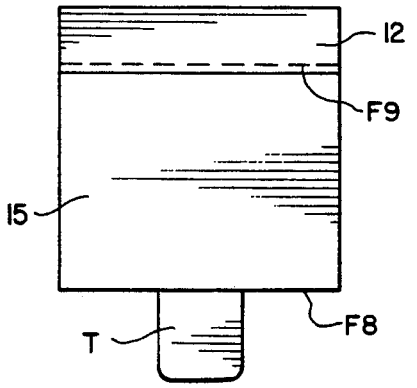
Figure 4D:
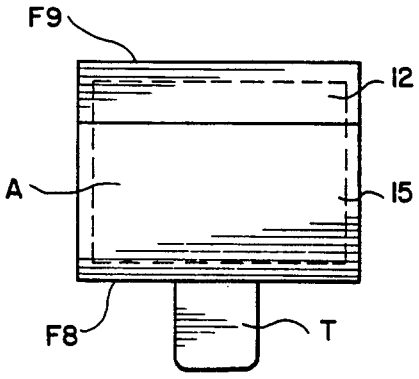

Referring to FIG. 4, in this embodiment, the wrapper is divided into four sections 12, 13, 14, and 15 along fold lines F7, F8, and F9. The tab T is cut from section 14 and is joined to section 13 along fold line F8 FIG. 4B shows a view of the wrapper after section 15 has been folded over section 14 along fold line F7 and tab T has been extended. FIG. 4C shows a view of the wrapper after sections 14 and 15 have been folded over section 13 along fold line F8. FIG. 4D shows a view of the wrapper after section 12 has been folded over section 15 along fold line F9. The broken lines show the position of the planar article A enclosed in the fourth embodiment.

FIG. 6 shows the wrappers connected two one another in a continuous sheet S prior to a final cutting along the lines of separation designated as L. Broken lines extending latitudinally show the continuation of the wrappers in both directions. This step is common to all embodiments.

It is to be understood that the present invention is not limited to the embodiments described above, but encompasses any and all embodiments within the scope of the following claims.

I claim:

1. A device for dispensing planar articles comprising:

a plurality of planar articles:

a plurality of wrappers each of said wrappers enclosing one of said planar articles to define a plurality of packets a container having wall elements defining a cavity;

said container having an upper portion and a lower portion and a dispensing port located proximate said lower portion:

said plurality packets stacked atop one another in said cavity;

whereby said packets may be removed from said container by manually pulling said packets from said dispensing port;

each of said wrappers comprising:

a generally rectangular sheet of foldable material having a first axis and a second axis normal to one another;

said sheet being folded along a plurality of fold lines parallel to said first axis and defining at least three panels on associated sides of said fold lines; and a tab element cut from one of said panels and integrally joined to an associated panel along a hinge line coincident with one of said fold lines; wherein said panels and fold lines comprise:

a first panel, a second panel, and a third panel, said first panel joined to said second panel along a first fold line, said second panel joined to said third panel along a second fold line.

said second and third panels being substantially rectangular and about the same size.

said first panel being substantially rectangular and about one half the size of said second and third panels, said tab element being located on said third panel and formed from a cut line, whereby said planar article is placed atop said second panel.

said third panel being positioned atop said planar article by rotating about said second fold line, said first panel being positioned atop said third panel by rotating about said first fold line and, said tab element being rotated about said second fold line until it rests against said second panel.

2. A device for dispensing planar articles as claimed in claim 1, wherein each cut line is alternately positioned along the second axis of each of said sheets, thereby providing said stacked plurality of packets having their respective tab elements in alternating offset positions, thus to obviate the possibility of each tab element engaging more than one of said packets.

3. A device as claimed in claim 1 wherein, prior to assembly, each generally rectangular sheet of foldable material was integrally connected along separation lines parallel to said second axis to at least one other of said sheets.

* * * * *